US005723832A

United States Patent [19]

Hall

[11] Patent Number: 5,723,832

[45] Date of Patent: Mar. 3, 1998

[54] SWITCH GUARD FOR ELECTRIC SWITCH ASSEMBLY

[76] Inventor: James K. Hall, 1466 Chicago Blvd., Detroit, Mich. 48206

[21] Appl. No.: 676,647

[22] Filed: Jul. 11, 1996

[51] Int. Cl.[6] ..... H01H 9/20

[52] U.S. Cl. ..... 200/43.16; 200/43.19

[58] Field of Search ..... 200/43.16, 43.19, 200/43.14; 174/66

[56] References Cited

U.S. PATENT DOCUMENTS

| | | | |
|---|---|---|---|
| 2,354,224 | 7/1944 | Stein . | |
| 3,170,050 | 2/1965 | Buturuga | 200/43.19 |
| 4,363,944 | 12/1982 | Poirier | 200/43.19 |
| 4,468,544 | 8/1984 | Wainess et al. . | |
| 4,876,425 | 10/1989 | Woskow | 200/43.16 |
| 5,009,610 | 4/1991 | Woskow | 439/142 |
| 5,278,365 | 1/1994 | Rowley et al. . | |
| 5,324,897 | 6/1994 | Melgoza et al. . | |
| 5,468,925 | 11/1995 | Mohsen | 200/43.16 X |
| 5,486,660 | 1/1996 | Fasano | 200/43.16 |
| 5,521,344 | 5/1996 | De Leo | 200/43.14 |

FOREIGN PATENT DOCUMENTS

| | | | |
|---|---|---|---|
| 208197 | 11/1959 | Belgium | 200/43.16 |
| 1040654 | 10/1958 | Germany | 200/43.16 |

*Primary Examiner*—Renee S. Luebke

*Attorney, Agent, or Firm*—Barnes, Kisselle, Raisch, Choate, Whittemore & Hulbert, P.C.

[57] ABSTRACT

An electric switch assembly having a switch arm movable from "on" to "off" position and a cover plate through which the switch arm extends. The cover plate has an integral guard providing a stop substantially abutting the switch arm when in one of its "on" and "off" positions and blocking movement of the switch arm to the other position. The cover plate may replace the conventional cover plate or serve as an auxiliary cover plate applied over the conventional cover plate.

2 Claims, 1 Drawing Sheet

FIG. 1

SWITCH GUARD FOR ELECTRIC SWITCH ASSEMBLY

FIELD OF INVENTION

This invention relates generally to electric switch assemblies and refers more particularly to an electric switch assembly having a cover plate provided with a guard to block the switch arm from being moved from "on" to "off" position or vice versa.

BACKGROUND OF THE INVENTION

Conventional electric switches are switched on and off by a switch arm. The switch is usually recessed in a wall and protected by a cover plate. The switch arm projects through an opening in the cover plate. There are instances in which it is desired to prevent the unauthorized switching of the switch arm from on to off position or vice versa, such as where the switch arm controls an important function, machine or device. As an example, the switch for the electrical control of a home heating furnace should be on at all times except when shut down for maintenance or repair. However the on-off switch is often placed near the floor within reach of a child. What is needed is a simple and effective guard for preventing the unauthorized operation of the switch.

SUMMARY OF THE INVENTION

In accordance with the present invention, the cover plate through which the switch arm extends has an integral guard providing a stop abutting the switch arm when in one of its on and off positions and blocking it from movement to the other position. Preferably, the integral guard is formed on the front face of the cover plate and projects outwardly therefrom with a blocking surface extending close to the switch arm. It is also preferred to construct the cover plate in a manner such that it can be reversed or mined end-for-end so that it will block the operation of the switch arm from on to off or from off to on, as desired. Alternatively, the integral guard may be formed on an auxiliary cover plate secured over the conventional cover plate.

One object of this invention is to provide a cover plate or auxiliary cover plate for an electric switch assembly having the foregoing features and capabilities.

Another object is to provide a cover plate or auxiliary cover plate which is rugged and durable in use and can be inexpensively and easily manufactured and installed.

These and other objects, features and advantages of the invention will become more apparent as the following description proceeds, especially when considered with the accompanying drawings.

DETAILED DESCRIPTION OF THE PREFERRED EMBODIMENT

Figure 1:
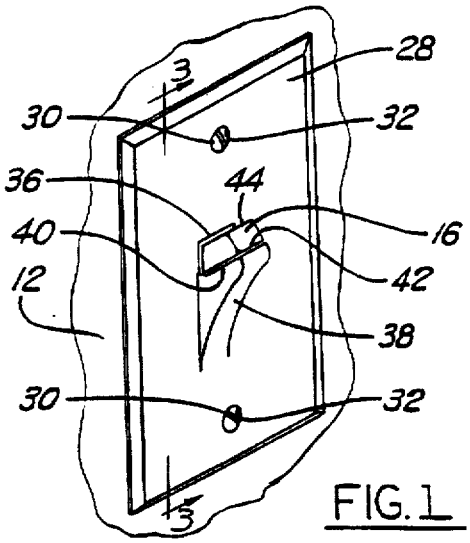
FIG. 1 is a perspective view of a switch assembly having a cover plate constructed in accordance with the present invention.
Figure 2:
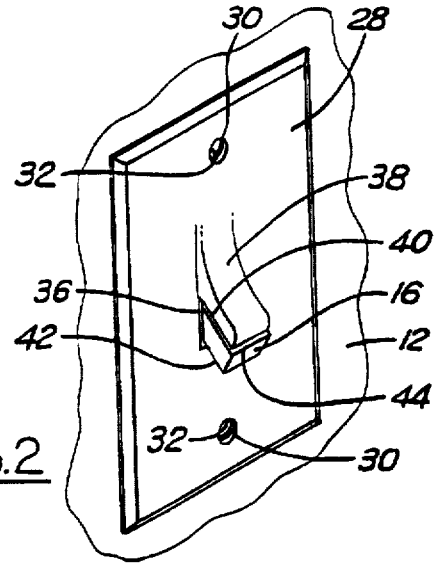
FIG. 2 is a perspective view similar to FIG. 1, but showing the cover plate in a reversed position.
Figure 3:
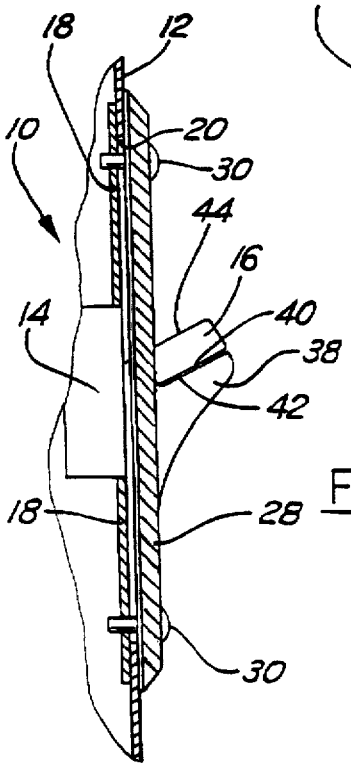
FIG. 3 is a sectional view taken on the line 3—3 in FIG. 1.

Referring now more particularly to the drawings and especially FIGS. 1–3, an electric switch assembly 10 is mounted on the inner side of a wall 12. The wall may be a vertical partition or wall in a room of a building such as a home or office. The switch assembly 10 comprises a switch 14 having an "on-off" switch arm 16, and a mounting frame 18. When the switch assembly 10 is mounted on the inner side of the wall as shown, the switch 14 is behind a wall opening 20.

The switch arm 16 projects from the switch 14 through the opening 20 and can be pivoted from an upwardly inclined position (usually the "on" position) of FIG. 1 to a downwardly inclined position (usually the "off" position) shown in FIG. 2.

A rectangular cover plate 28 is secured to the frame 18 of the switch assembly by screws 30. The screws 30 extend through holes 32 in the cover plate and thread into pretapped openings in the frame. The cover plate has a slot 36 through which the switch arm 16 extends. The cover plate 28 has a peripheral flange 29 extending rearwardly from the plane of the cover plate at a flaring angle to contact the wall 12.

The cover plate 28 has an integral guard 38 projecting outwardly from its outer surface adjacent to the slot 36 therein. The guard 38 has an inclined blocking surface 40 which is slanted so as to be substantially parallel with the adjacent lower surface 42 of the switch arm 16 as shown in FIG. 3. FIG. 3 shows the switch arm pivoted to its upper position, which is usually the "on" position, and thus the lower surface 42 of the switch arm is closely adjacent to and also parallel to the inclined blocking surface 40 of the integral guard 38. Accordingly, the switch arm cannot be switched downwardly to its off position while the cover plate is in place.

It is possible to remove the screws 30, reverse the cover plate end for end, that is, turn it 180°, to the position shown in FIG. 2, in which the integral guard 38 is above the slot 36, rather than below it as in FIGS. 1 and 3. In the FIG. 2 position, the screws are re-attached to the frame 18 of the switch assembly and in this position the integral guard 38 prevents the switch arm from moving from the illustrated "off" position in which it extends downwardly, to the "on" position. In this "off" position of FIG. 2, the top surface 44 of the switch arm 16 is substantially parallel to the inclined blocking surface 40 of the integral guard and so close to the switch arm that it cannot be moved to the "on" position.

In accordance with this invention, the integral guard on the cover plate has a blocking surface 40 providing a stop substantially abutting the switch arm so that the switch arm may be retained either in its "off" or its "on" position, thus solving in a very simple manner the problem of preventing unauthorized operation of the switch arm by a child or other unauthorized person.

Figure 4:
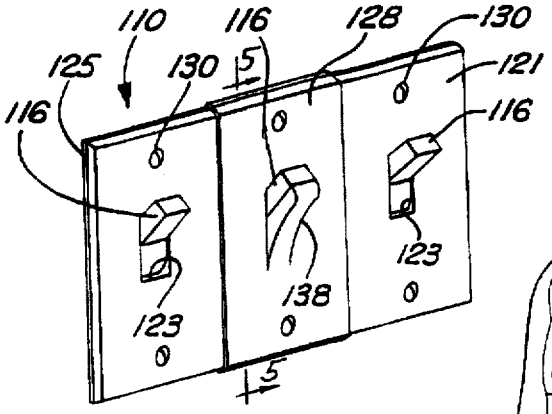
FIG. 4 is a perspective view showing a modification.
Figure 5:
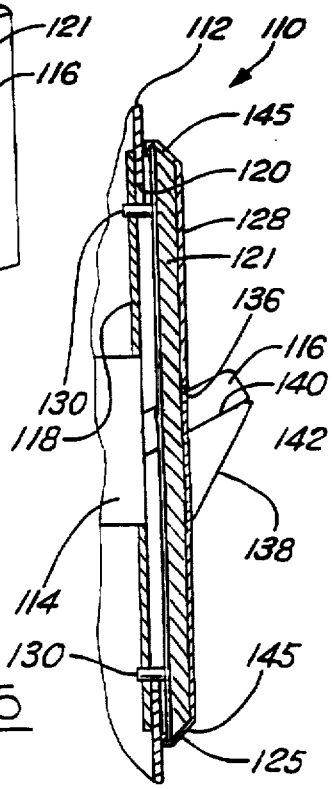
FIG. 5 is a sectional view taken on the line 5—5 in FIG. 4.

FIGS. 4 and 5 show a modification of the invention for use with an electric switch assembly having more than one switch and it is desired to lock the switch arm of only one of the switches in the "on" or "off" position.

As seen in FIGS. 4 and 5, an electric switch assembly 110 is mounted on the inner side of a wall 112, like the wall 12 in the first embodiment. The switch assembly 110 comprises three switches, one of which is indicated at 114 in FIG. 5 and each having an "on-off" switch arm 116. A mounting frame 118 supports all of the switches. When the switch assembly 110 is mounted on the inner side of the wall as shown, the switches are behind a wall opening 120.

The switch arms 16 project from the switches through the opening 120 in the wall and can be pivoted from an upwardly inclined position as shown in FIGS. 4 and 5 to a downwardly inclined position.

A rectangular cover plate of conventional construction, designated 121, is secured to the frame 118 of the switch assembly by screws 130. The screws 130 extend through holes in the cover plate and thread into three tapped openings in the frame. The cover plate has slots 123 through which the switch arms 116 extend. As stated, the cover plate 121 is of conventional construction and has a peripheral flange 125 extending rearwardly from the plane of the cover plate at a flaring angle to contact the wall 120.

A rectangular cover plate 128 serves the same function as cover plate 28 in the first embodiment. However, in this instance, the cover plate 128 is an auxiliary cover plate applied over the conventional cover plate 121. The cover plate 128 is secured over the cover plate 121 as by the screws 130 and is formed with a slot 136 to clear the center switch arm 116. This auxiliary cover plate 128 is narrower than cover plate 121 so that it does not cover the two switch arms on either side of the center switch arm.

The auxiliary cover plate 128 has an integral guard 138 (substantially the same as guard 38 on plate 28 of the first embodiment) which projects outwardly from its outer surface adjacent the slot 136 therein. The guard 138 has an inclined blocking surface 140 which is slanted so as to be substantially parallel to the adjacent lower surface 142 of the switch arm 116 as shown. FIGS. 4 and 5 show the switch arm 116 pivoted to its upper position, and thus the lower surface 142 of the switch arm is closely adjacent to and also parallel to the inclined blocking surface 140 of the integral guard 138. Accordingly, the switch arm cannot be switched downwardly to its off position while the auxiliary cover plate is in place.

The auxiliary cover plate 128 has top and bottom flanges 145 and 147 which extend rearwardly from the plane of the auxiliary cover plate at a flaring angle to contact the wall 120. The side edges of the cover plate 128 do not have rearwardly extending flanges so that the cover plate can lie flush against the outer surface of the standard cover plate 125 in the central position as shown.

The auxiliary cover plate 128 can obviously be moved from its position blocking operation of the center switch arm to a position blocking operation of either one of the other two switch arms, by merely moving it left or right in FIG. 4 and reattaching it by the appropriate screws 130. The auxiliary cover plate 128 can be reversed end-for-end so that the integral guard is above the slot 136 rather than below it, and reattached to the frame to prevent movement of the switch arm in the opposite direction. The auxiliary cover plate may be made of transparent material, if desired, so as to be less obtrusive.

What is claimed is:

1. A wall mounted electric switch assembly comprising an electric switch and a mounting frame on which said switch is mounted, a switch arm projecting from said switch and movable from an "on" to an "off" position, and a cover plate removably attached to said mounting frame covering and protecting the switch, said cover plate having a rear surface facing said switch and also having a from surface, said cover plate having a slot through which the switch arm extends, said cover plate having an integral guard formed on and projecting outwardly from said front surface adjacent to said slot providing a stop adapted to substantially abut the switch arm when in one of its "on" and "off" positions and blocking it from movement to the other of said positions.

2. The wall mounted electric switch assembly defined in claim 1, wherein said cover plate is reversible and removably attachable to said mounting frame in reversed position so that when attached to said mounting frame in reversed position, said guard will provide an abutment for the switch arm when the switch arm is in the other of its "on" and "off" positions.

* * * * *